US005127375A

United States Patent [19]

Bowman et al.

[11] Patent Number: 5,127,375

[45] Date of Patent: Jul. 7, 1992

[54] HYDRAULIC VALVE CONTROL SYSTEM FOR INTERNAL COMBUSTION ENGINES

[75] Inventors: Timothy J. Bowman, Bexley, Great Britain; Julian A. LoRusso, Grosse Ile, Mich.; Warren F. Kaufman, Santa Ana, Calif.

[73] Assignee: Ford Motor Company, Dearborn, Mich.

[21] Appl. No.: 680,221

[22] Filed: Apr. 4, 1991

[51] Int. Cl.[5] ..... F01L 9/02; F01L 1/34

[52] U.S. Cl. ..... 123/90.12; 123/90.16

[58] Field of Search ..... 123/90.12, 90.13, 90.15, 123/90.16

[56] References Cited

U.S. PATENT DOCUMENTS

| | | | |
|---|---|---|---|
| 1,760,853 | 5/1930 | Wood | 123/90.13 |
| 3,534,718 | 10/1970 | Pasquin | 123/90.13 |
| 3,683,874 | 8/1972 | Berlyn | 123/90.12 |
| 3,963,006 | 6/1976 | Firey | 123/90.12 |
| 3,963,007 | 6/1976 | Baker | 123/90.16 |
| 4,153,016 | 5/1979 | Hausknecht | 123/90.12 |
| 4,258,672 | 3/1981 | Hietikko | 123/90.12 |
| 4,357,917 | 11/1982 | Aoyama | 123/90.12 |
| 4,407,323 | 10/1983 | Neff | 137/454.2 |
| 4,444,214 | 4/1984 | Paul, Jr. | 137/68 R |
| 4,466,390 | 8/1984 | Babitzka et al. | 123/90.16 |
| 4,475,497 | 10/1984 | Honda et al. | 123/198 F |
| 4,509,467 | 4/1985 | Arai et al. | 123/90.16 |
| 4,546,734 | 10/1985 | Kodama | 123/90.16 |
| 4,577,653 | 3/1986 | Marty | 137/119 |
| 4,615,306 | 10/1986 | Wakeman | 123/90.16 |
| 4,671,221 | 6/1987 | Geringer et al. | 123/90.16 |
| 4,674,451 | 6/1987 | Rembold et al. | 123/90.16 |
| 4,694,787 | 9/1987 | Rhoads | 123/90.13 |
| 4,716,863 | 1/1988 | Pruzan | 123/90.12 |
| 4,796,573 | 1/1989 | Wakeman et al. | 123/90.16 |
| 4,887,462 | 12/1989 | Wakeman | 123/90.12 |

*Primary Examiner*—E. Rollins Cross
*Assistant Examiner*—Weilun Lo
*Attorney, Agent, or Firm*—Jerome R. Drouillard; Roger L. May

[57] ABSTRACT

A modular hydraulic valve actuating assembly for use in association with a single combustion chamber in a multicylinder internal combustion engine cylinder head. The assembly includes a housing having a mounted surface to attach to the cylinder head immediately above a poppet valve. The housing includes a first cavity spaced from and oriented non-parallel to the poppet valve, a second cavity coaxially aligned with the poppet valve, and a fluid passageway extending between and hydraulically coupled to the first and second cavities. A master piston within the housing co-operates with a camshaft to define a first enclosed fluid chamber which varies in displacement as the master piston is reciprocally oscillated by the camshaft. A slave piston within the housing co-operates with the poppet valve to define a second enclosed fluid chamber hydraulically connected to the first and varying in displacement as the slave piston oscillates. A valve means within the housing regulates the flow of fluid from the pressurized master cylinder through an accumulator fluid port thereby automatically varying any one or more of valve lift, valve timing or duration of valve opening in response to an input signal at any point during engine operation.

7 Claims, 6 Drawing Sheets

Fig-5A
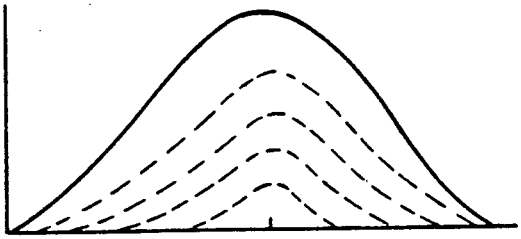
Fig-5B
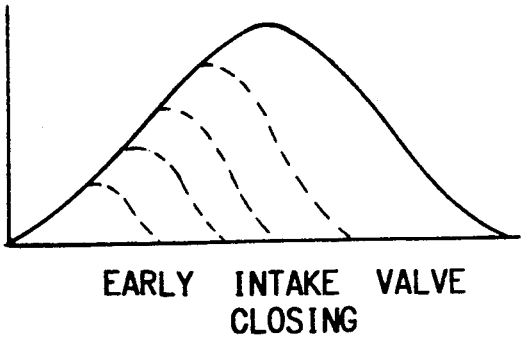
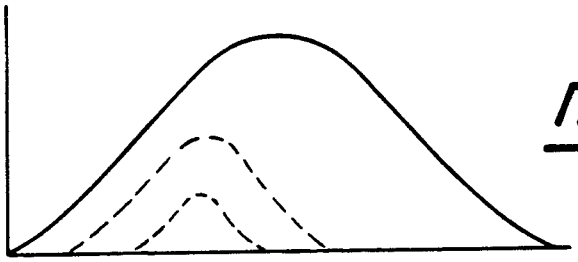
Fig-5C
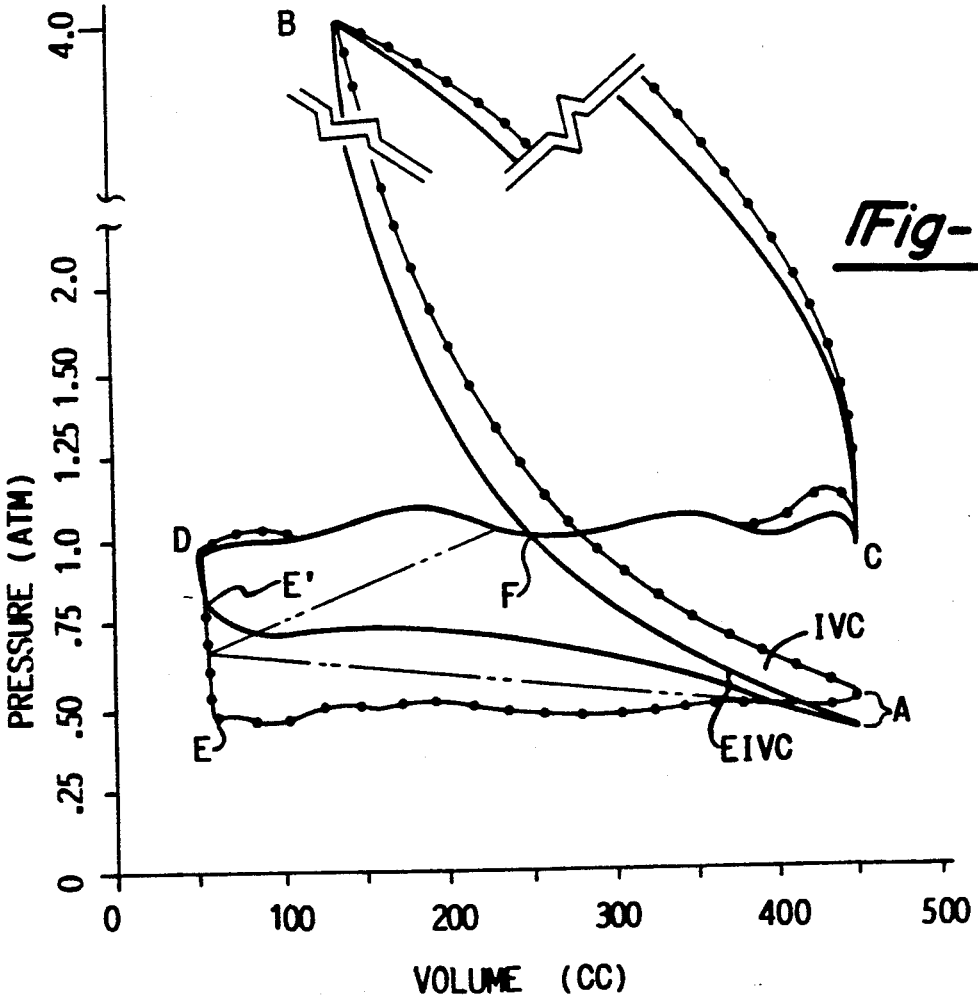
Fig-6

HYDRAULIC VALVE CONTROL SYSTEM FOR INTERNAL COMBUSTION ENGINES

TECHNICAL FIELD

The present invention relates to hydraulic valve control systems for internal combustion engines and more particularly to systems for controlling the opening, closing and degree of lift of the combustion chamber intake and exhaust valves.

BACKGROUND OF THE INVENTION

In recent years, increased emphasis has been placed on development of the internal combustion engine, particularly for vehicular applications, to produce engines having high power output per weight ratios, good fuel economy and maximum quality. Technological development has been rapid. A substantial portion of development work on the four-cycle internal combustion engine has been directed to increasing the power or total work of the engine by improving the combustion and expansion portion of the power cycle. To a lesser extent, development has centered around decreasing the amount of work expended during the intake and exhaust portions of the work cycle. In each case, attention has been directed to the intake and exhaust valve systems, their structure and control. Amongst these systems are those providing for variable valve timing for both the intake and exhaust valves, and for variable valve lift. The advantages of these mechanisms are numerous and fairly well known.

In many instances, the valves are operated by hydraulic control. This permits flexible control strategies, such as lost-motion valve lift systems wherein the pressurized fluid is drawn off in a controlled manner rather than being allowed to act directly upon the mechanisms controlling valve lift. Such a system has the advantage of providing for variable control of intake, timing, duration and valve lift. However, achieving a practical and cost-effective design using hydraulics can be difficult for several reasons. High system fluid pressure requires careful control of clearances between moving parts to limit fluid leakage. Similarly, sealing of assembled parts becomes difficult and usually requires elastomer seals. Yet another problem is the sealing of the porosity of aluminum castings which have many times been proposed for use in housing hydraulic components and high pressure auto passages to minimize weight.

An example of the more recently developed hydraulic valve control arrangements is shown in U.S. Pat. No. 4,671,221 wherein it is noted that the entire hydraulic mechanism includes: a cam follower, piston and pump actuated by the camshaft; an electromagnetic actuated valve for bleeding off the hydraulic fluid from the slave piston; an accumulator for storing the fluid temporarily bled from the system; and the hydraulically actuated slave piston which directly actuates the poppet valve (intake valve).

Similar systems are shown in U.S. Pat. No. 4,466,390 and U.S. Pat. No. 4,674,451.

In each case, the valve Control system, being located in a separate housing co-extensive with the cylinder head, or in the cylinder head itself, presents substantial manufacturing problems including the costs associated with manufacturing such an assembly, the sealing problems inherent in such a design, and the problem of assembling the system in a "clean" environment.

U.S. Pat. No. 3,963,006 is a further example of a hydraulically actuated valve train system, and in this case is built into the engine cylinder head as an integral part thereof.

Likewise, U.S. Pat. No. 1,760,853 shows a hydraulically actuated valve system designed as a single unit that may be adapted for ready attachment to the engine block and includes hydraulically actuated valve lift mechanisms for each of the intake and exhaust valves for the entire cylinder bank.

In light of these teachings, and considering the demands of the present automotive industry, the inventors felt there existed a need for developing a modular cartridge concept maximizing the usage of common hydraulic actuators among engine families, one which would permit hydraulic valve control to be more production feasible by improving the quality of design and reducing the cost, and one permitting the integration of the hydraulic components into subassemblies which could be assembled separately for the main engine assembly line in a "clean room" environment.

The present invention is directed towards these ends.

SUMMARY OF THE INVENTION

The present invention has for some of its objects the following:

1. Integrating hydraulic components into self-contained subassemblies which may be assembled separately from the main engine assembly line in a clean room environment;
2. A modular cartridge concept which maximizes usage of common hydraulic actuation assemblies;
3. Permitting hydraulic valve control to be more production feasible by improving the quality of design and reducing the cost;
4. Providing a modular cartridge concept which maximizes usage of common hydraulic actuators among engine families.

Briefly, the invention pertains to a hydraulic engine valve actuating assembly for use in an internal combustion engine cylinder head having a poppet valve which is axially shiftable therein by a rotary camshaft.

The hydraulic engine valve actuating assembly includes a housing having a mounted surface to attach to the cylinder head immediately above the poppet valve. The housing has formed therein a first cavity spaced from and oriented non-parallel to the poppet valve, a second cavity coaxially aligned with the poppet valve, and a fluid passageway extending between and hydraulically coupled to the first and second cavities.

A master piston within the housing cooperates with the camshaft and sealingly engages the first cavity to define a first enclosed fluid chamber which varies in displacement as the master piston is reciprocally oscillated by the camshaft to provide a high pressure fluid source.

A slave piston within the housing cooperates with the poppet valve and sealingly engages the housing second cavity to define a second enclosed fluid chamber hydraulically connected with the high pressure fluid source which varies in displacement as the slave piston and poppet valve reciprocally oscillate.

A hydraulic energy and fluid storage accumulator assembly is affixed within and sealed relative to the housing and provided with a fluid port coupled with the housing fluid passageway.

Finally, a valve means is provided within the housing for regulating the flow of fluid from the high pressure source through the accumulator fluid port to vary any one or more of valve lift, valve timing or duration of valve opening in response to an input signal.

The invention also includes as one of its objects the preventing of pump-up of the hydraulic lash adjusters which control the degree to which the hydraulically actuated poppet valve seats on the valve seat, wherein the unique features of the lash adjuster include a timed oil supply to the lash adjuster and the ability to control the oil supply pressure to the lash adjuster.

To this end, in one embodiment, the slave piston includes a lash adjuster coaxially located therewithin as a piston within a piston and adapted to directly engage the poppet valve. The lash adjusting piston includes a one-way, spring-biased, normally closed check valve for hydraulically adjusting the axial extent of the lash adjusting piston relative to the slave piston. Also, the housing includes a second fluid passageway for admitting fluid from a low pressure fluid source to the lash adjusting piston.

The above objects and other objects, features, and advantages of the present invention are readily apparent from the following detailed description of the best mode for carrying out the invention when taken in connection with the accompanying drawings.

BRIEF DESCRIPTION OF THE DRAWINGS

FIGS. 5A–5C graphically illustrate various control strategies for varying the lift of the engine intake valves using the present invention;

FIG. 6 is a graphical representation of combustion chamber pressure versus combustion chamber volume during a work cycle of a four-cycle internal combustion engine and illustrating the savings in work utilizing the present invention.

BEST MODE FOR CARRYING OUT THE INVENTION

Figure 1:
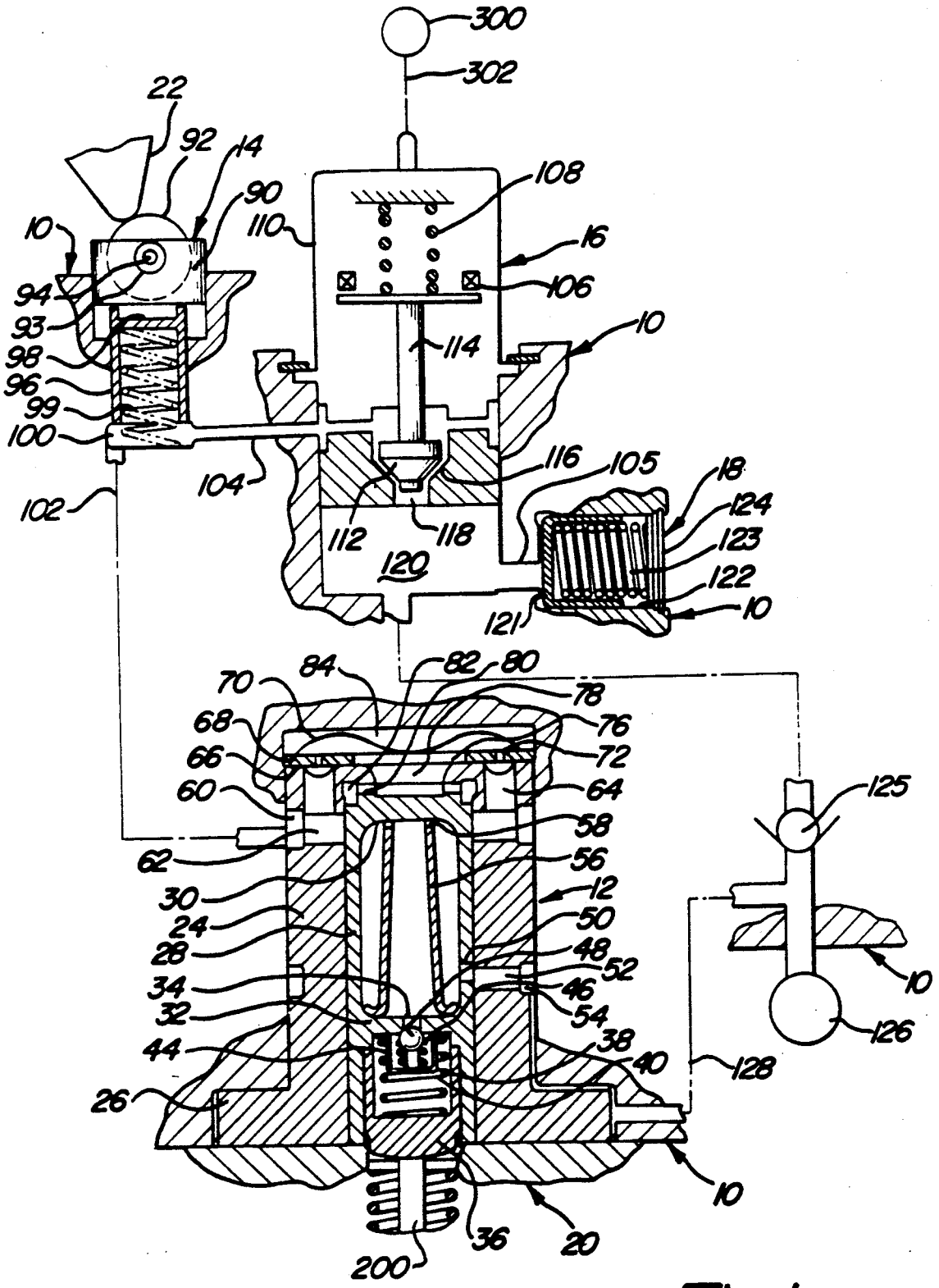
FIG. 1 is a generally schematic and exploded representation of the hydraulic controlled valve lifter assembly for an engine valve in accordance with the present invention.

FIG. 1 shows schematically the general hydraulic system of the valve lifter cartridge module, generally designated 10 of the present invention as well as the structural details of the basic components which include a valve actuator assembly generally designated 12, a cam follower assembly generally designated 14, solenoid valve assembly generally designated 16, and an accumulator generally designated 18. All of the aforementioned elements are located within the cartridge module 10 shown in full perspective in FIG. 2 which is adapted to be bolted to the cylinder head, generally designated 20, between it and a camshaft carrying a plurality of engine valve lift cams 22.

As seen in FIG. 1, the valve actuator assembly includes an annular housing 24 having an annular flange 26 at the base end thereof 26 to axially locate it within the cartridge module 10. Within the actuator housing, there is an actuator piston assembly 28, which as explained below functions as a slave piston. The actuator piston is basically a cylindrical sleeve closed at its upper end by an end wall 30 and having an intermediate wall 32 dividing the piston into an upper section and a lower section. The intermediate wall includes an orifice 34.

The lowermost section includes a lash adjusting assembly comprising a piston 36 having a head portion abutting the end of the valve stem of the poppet valve 200. The lash adjusting piston 36 includes a cylindrical skirt 38 defining an annular cavity within which is positioned a lash adjustment spring 40 bearing against the piston head 42 at its lower end and against a cup member 44 at its upper end. Within the cup member is positioned a ball valve spring 46 which maintains a ball valve 48 in a normally closed position relative to the orifice 34.

The upper section of the actuator piston includes an orifice 50 which, as shown, is in open communication with a hydraulic passage 52 within the actuator assembly housing which, in turn, is in open communication with a hydraulic supply port in the form of an entrance annulus 54. In actual practice, there will be a plurality of orifices 50 and hydraulic passageways 52 placed about the circumference of the actuator piston and actuator housing, respectively, such that regardless of the relative radial position of the piston within the housing, there will be assured open communication between the respective hydraulic passageways when the actuator piston 28 is in a predetermined axial position relative to the housing 24. Within the internal cavity formed within the actuator piston between end wall 30 and intermediate wall 32 there is placed a slightly tapered, generally cylindrical baffle member 56 having one or more hydraulic passages 58 at its upper end adjacent the end wall 30. In actual manufacture, the piston 28 will be of two pieces, preferably split midway of the internal cavity, with the two pieces then being fixedly joined together in any suitable manner after insertion of the baffle member 56.

At its upper end, the actuator housing 24 includes an entrance annulus 60 in open communication with one or more free-flow orifices 62. Orifices 62 may be round or rectangular in shape, and where a plurality of orifices are provided, they will preferably be radially equally spaced about the circumference of the housing 24. Axially extending hydraulic passages 64 are in open communication with the free flow orifices 62 and are open to the end wall 66 of the housing. An annular limiter or check washer 68 is resiliently biased, by a doughnut-shaped wave spring 70, against the end wall of the actuator housing. Alternatively, the check washer 68 and wave spring 70 could be integrated into a single part. Being open at its central position, the wave spring 70 offers no impediment to fluid flow to the piston 28. The check washer includes a plurality of relatively minute passages providing damping orifices 72 radially spaced about the outer extent of the check washer and in open communication with the passageway 64. The relative sizing of the orifices 72 is selected so as to promote turbulent flow rather than laminar flow from main orifice 78. By doing so, the unit operation is much less dependent on fluid viscosity and therefore temperature change. The check washer further includes a main flow orifice 76 located centrally of the check washer and in open communication with a central passage 78 formed in the end wall of the housing. Central passage 78 is in open communication with a plurality of radially extending, circumferentially spaced passages 80 located on the actuator piston assembly 28 and formed at the lower end of central passage 78 and in open communication with an internal annulus 82 that is open to the outer peripheral extent of the end wall 30 of the actuator piston. The difference in axial extent between the actuator housing and the cylindrical cavity within the cartridge housing forms the cavity 84 within which the wave spring is held.

Figure 3:
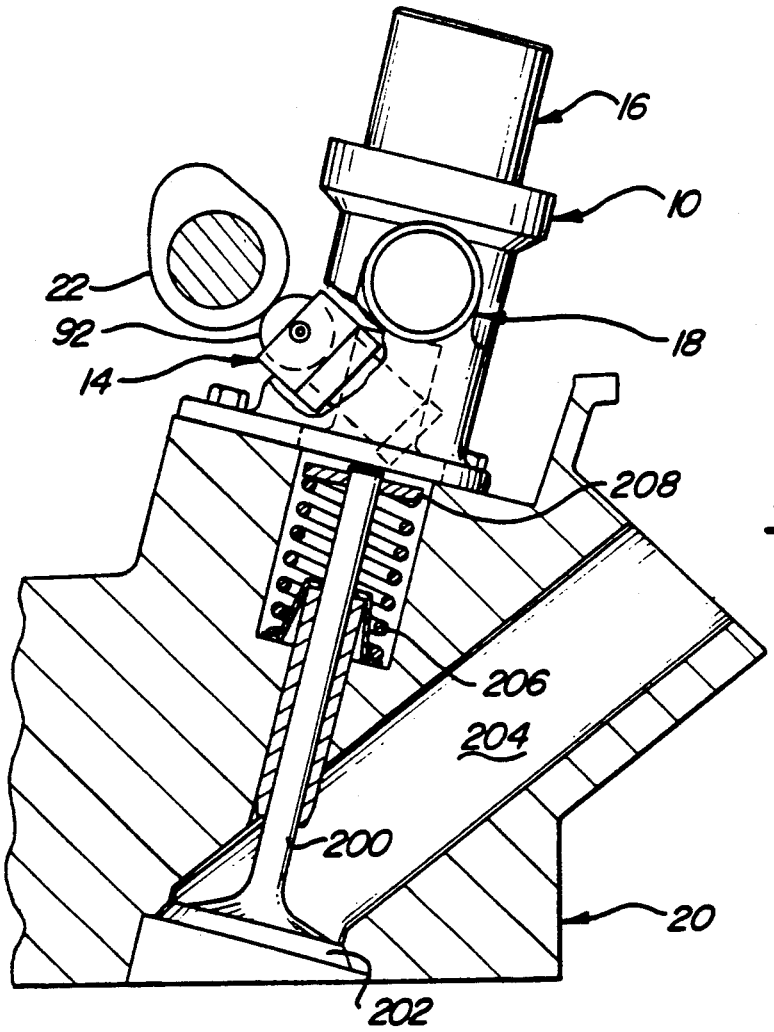
FIG. 3 is a side elevation view of the cartridge-type hydraulically actuated valve control system in combination with an actuating camshaft and cylinder head assembly in accordance with the present invention.

It will be noted that the engine poppet valve 200, shown in FIGS. 1 and 3, is held in a normally closed position upon the valve seat 202 of intake passage 204 within the cylinder head by means of valve spring 206 and valve washer 208. The cylindrical helical valve spring 206 is abutted at one end against a surface within the cylinder head whereas the valve washer is affixed to the valve stem.

Hydraulically coupled to the hydraulic entrance annulus 60 is a hydraulic cam follower assembly 14.

Figure 2:
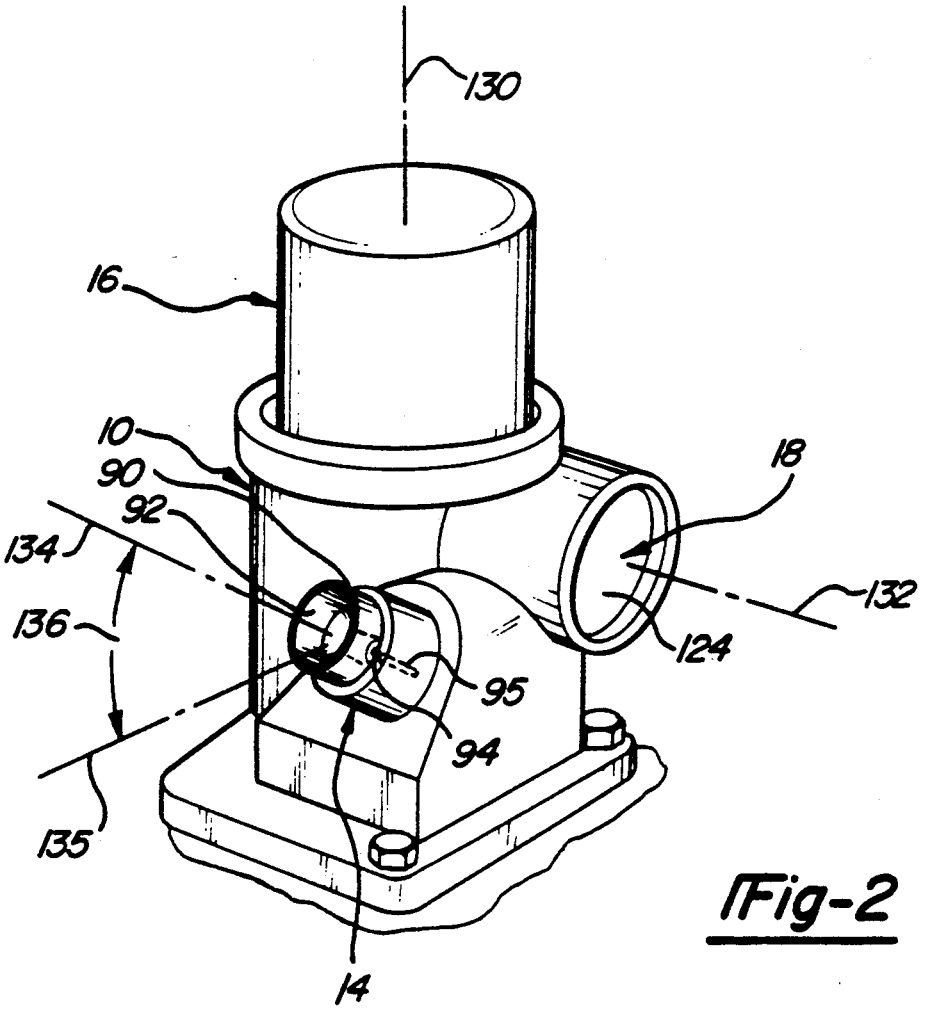
FIG. 2 is a perspective view of the cartridge-type hydraulically actuated valve control system in accordance with the present invention.

The cam follower assembly 14 includes an upper cylindrical cup-shaped member 90, having a roller 92 rotatably supported by means of an axle 93. As shown in FIG. 2, a pin 94 radially projects beyond axle 93 and is loosely fitted within a slot 95 in the housing to preclude rotation of the cup-shaped member 90. Roller 92 is adapted to engage a lobe of the engine camshaft. The bottom of the cup-shaped member 90 engages a cylindrical sleeve member 96 which, as explained below, constitutes a master piston. Both the cup member and cylindrical sleeve member are coaxially located within an annular cavity within the cartridge module 10. The cylindrical sleeve member includes an end wall 98. A cylindrical helical spring 99 is located within and coaxially aligned with the sleeve member and bears against the end wall 98 to bias the cylindrical sleeve member and, consequently, the cam follower against the cam lobe. Spring 99 is in constant compression throughout the axial travel of the sleeve member 96 as determined by the lift of the cam lobe. Sleeve member 96 is open to a hydraulic cavity 100 whereby hydraulic fluid can be pumped to either the hydraulic passage 102 leading to the actuator assembly or through hydraulic passages 104,105 leading to an accumulator 18 or both.

A solenoid valve assembly 16 is positioned intermediate the cam follower assembly 14 and the accumulator 18. It is conventional in structure and includes an electromagnetic coil 106 within the upper portion 110 of the assembly. A piston 112 is affixed to a core rod 114 which is magnetically attracted to the coil 106 each time the coil is energized. The timing of the solenoid valve assembly being energized is controlled by an electric control, shown schematically as 300,302. A coil spring 108 abuts rod 114 and maintains the valve assembly in a normally closed position by holding piston 112 against valve seat 116 and closing off outlet port 118. An alternative design maintaining the valve assembly in a normally open position could also be considered. Upon being energized, valve piston 112 is caused to be lifted from valve seat 116 thereby allowing hydraulic fluid to be bled from the main hydraulic circuit to the cavity 120 and then stored within the accumulator 18 in a manner to be described below.

The accumulator 18 includes a cup-shaped piston 121 adapted to reciprocate within cylindrical chamber 122 and held in a normally closed position across inlet passage 105 by a coil spring 123 which abuts a stationary end wall 124.

A one-way acting check valve 125 is located between an oil gallery generally designated by the numeral 126 and the cavity 120 of the solenoid check valve. The oil pressure within oil gallery 126 is relatively low, e.g., 100 psi or less under fully warmed up engine conditions, compared to that developed by the cam follower assembly 14.

The passage 128 within the cartridge housing provides hydraulic fluid to the lash adjuster input annulus 54.

In FIG. 2, the cartridge is shown as an assembled module. Although not shown except schematically in FIG. 1, it is to be noted that the valve actuator assembly 12 and solenoid valve assembly 16 are vertically oriented along the same axis 130. The accumulator 18 is located coaxially on an axis 132 extending perpendicular to axis 130.

Uniquely, the cam follower assembly is located coaxially with an axis 134 extending at an acute angle 136 relative to the base of the cartridge housing as represented by line 135 which is perpendicular to axis 130.

The angular disposition of cam follower assembly 14 is seen best in FIG. 3. The angle 136 may vary anywhere from 20° to 75°, and will usually be about 40° to 55° from line 135, which is 15° to 70° off-axis from the axis 130, dependent upon specific engine designs. It will be appreciated that by locating the cam follower assembly at the acute angle 136 relative to the base and the abutting complementary surface 21 of the cylinder head, the overall height of the engine block may be maintained at a minimum.

If desired, the solenoid valve assembly 16 could also be located off axis to the engine valve thereby reducing the overall height of the cartridge module 10. In other words, were the cam follower assembly to be mounted on an axis extending parallel to the main axis 130 of the cartridge, as is the case with known devices wherein the cam follower means is part of the cylinder head, the overall distance between the cylinder head and camshaft would have to be increased an amount to accommodate the axial reciprocating length of the cam follower assembly.

Figure 4:
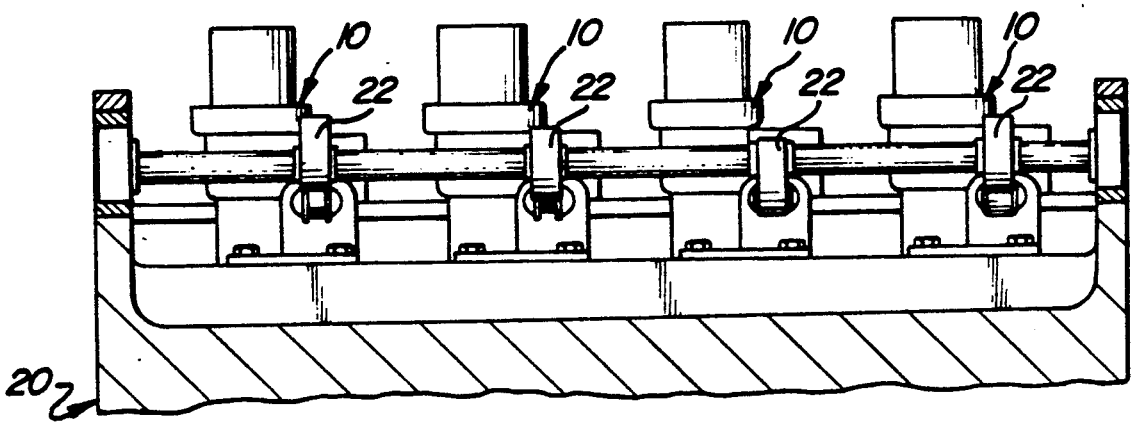
FIG. 4 is a perspective view of a cylinder block showing a plurality of cartridge-type hydraulically actuated valve control systems mounted serially, in combination with each respective cylinder within the block in accordance with the present invention.

As seen in FIG. 4, each combustion chamber is to include a cartridge module 10 mounted to the cylinder head to control the intake valve for that respective cylinder. Each cartridge module is separately bolted to the cylinder head and comprises, as described above, a complete unit in and of itself. This completely packaged cartridge may thus be assembled in any location separate from the production assembly line. For example, it can be assembled in a "clean room", free of contaminants and under the close supervision of highly skilled personnel, thereby assuring the highest level of quality and reliability in the assembly.

The operation will now be described, looking chiefly at FIG. 1, and assuming for the moment that (i) the lash adjustment has been made and (ii) the hydraulic system is fully filled from the oil supply. As the cam lobe 22 of the camshaft rotates upon the cam roller follower 92, the upper cup-shaped member 90 and with it the lower cylindrical sleeve member 96 will be caused to reciprocate with the rise and fall of the cam lift. With the solenoid piston 112 in the closed position, no hydraulic fluid will be allowed to flow from the cavity 120 through the passage 105 to the accumulator 18. Consequently, all hydraulic fluid will be routed through the passage 102 to the valve actuator assembly. By proportioning of the hydraulic fluid passages 62, 64 and 72 in the upper end of the valve actuator housing, the hydraulic fluid will be caused to flow at a predetermined flow rate to the head or end Wall 30 of the actuator piston causing it to axially extend downwardly against the engine valve stem, thus opening the valve at valve seat 202. Since the passageway 104 to the solenoid valve assembly and accumulator is closed, the valve will be caused to travel its full extent as shown in solid line in FIGS. 5A, 5B and 5C. After the point of maximum lift has been passed on the cam lobe, the cylindrical sleeve member 96 of the cam follower assembly will be caused to return under action of the helical cylindrical spring 99, thereby reducing the pressure bearing against the valve actuator piston head 30. Upon this reduction of pressure, the valve actuator piston 28 will be caused to return to its initial position by action of the valve return spring 206, and consequently, the valve itself will return to its original seated position.

The operation as described includes no adjustment of the valve lift since the solenoid valve assembly 16 and accumulator 18 were maintained totally inactive.

An object of the invention is to be able to control the valve lift and to vary the valve lift at will during operation of the vehicle in response to other engine performance parameters so as to increase the maximum efficiency and performance of the vehicle. This is controlled by the electronic sensor and control 300 which is electronically coupled to the solenoid valve via line 302. Upon energizing the solenoid as may be programmed, the solenoid valve piston 112 will be drawn in the direction of the electromagnetic coil 106 and opening outlet port 118 so that fluid communication is established from the hydraulic cavity 100 to the solenoid valve hydraulic cavity 120 and thence to the accumulator 18.

Then, upon rotation of the camshaft cam lobe 22 from a position of zero lift to a position of maximum lift, the cam follower sleeve member 96 will again be caused to stroke downwardly to pump fluid out of the hydraulic cavity 100. Depending on the degree and duration that the hydraulic passage 104 at its juncture with the solenoid valve hydraulic cavity is open, a predetermined amount of hydraulic fluid will be pumped to the accumulator 18. The pressure of the hydraulic fluid at the accumulator piston 112 will exert a force greater than that of the pressure force of the accumulator spring 123, consequently causing the accumulator piston 121 to recede within the chamber 122 and allowing displacement of the hydraulic fluid pumped from the cylindrical sleeve member 96. The effect on the valve actuator piston is that less hydraulic fluid will be allowed to flow to the valve actuator piston head 30. Consequently, the valve lift will be reduced as shown in dotted line in FIG. 5A. The more fluid that is funneled to the accumulator, the less will be the lift, as is also represented in FIG. 5A in dotted line.

By other means, not forming a part of this invention, (e.g. by varying valve timing) the intake valve can be caused to close early as shown in FIG. 5B. Alternatively, the same result can be caused by timing the actuation of the solenoid valve to delay the bleeding off of hydraulic fluid to the accumulator. Still another control strategy as shown in FIG. 5C is to provide an early intake valve closing which borders on being a centered lift in combination with the variable valve lift adjustment assembly as described above.

FIG. 6 shows in dashed line the typical work curve for a four-cycle internal combustion engine, and from it, the overall general principles of the present invention can be understood. That portion of the curve from points A to B represents the compression stroke. At point A both the intake valve and the exhaust valve are closed and the air/fuel mixture within the combustion chamber is compressed to a volume and pressure represented by the point B. At point B, ignition occurs and the combustion chamber expands as the piston recedes from points B to C. At point C, the exhaust valve begins to open and the exhaust gases are flushed from the combustion chamber as the piston moves from bottom dead-center to top dead-center as represented by the point D of the curve. At point D, the intake valve begins to open to bring fresh air to the combustion chamber. At the initial opening of the intake valve, there is a dramatic decrease in pressure from points D to E on the curve. Thereafter as the piston recedes to bottom dead-center as represented at point A on the curve, the requisite amount of new air is brought in through the intake valve. Points E and A are at sub-atmospheric pressure since the incoming air through the intake valve is filling a vacuum drawn by the piston as it reciprocates towards the bottom dead-center. The cycle then begins again with the compression stroke from points A to B of the curve. That portion of the performance or work curve represented by the points A, F, D and E is negative work.

The engine's performance can be increased by decreasing the amount of negative work. Such a decrease in the area under the curve and therefore negative work is brought about by the present invention in that by limiting the valve lift, the degree of blow down (represented by that portion of the curve between points D-E), is limited to that as represented in solid line as between points D and E'. The pressure drop will be less dramatic at point E', and the pressure will continue to drop from point E' throughout the downward stroke of the piston such that at bottom dead-center position of the piston, point A will remain unchanged. At the initiation of the compression cycle, the cylinder will be operating at the same volume and pressure selected for the power portion of the work curve A-B-C-F. The result is a decrease in the amount of lost work represented by the area under the negative curve represented by the points A-F-D-E'-A.

The modified negative work curve shown in dotted line at points A-F-D-E'-A represents an example of early intake valve closing as depicted in FIG. 5B. To establish such a curve it is necessary that the solenoid valve piston 112 remain in a closed position so that the intake valve opens at the time that it normally would for a conventional high speed, full load power curve as shown in the work curve represented by the points A-F-D-E-A. However, at a predetermined time prior to the valve being completely opened, the solenoid valve is actuated so that the hydraulic fluid is drained from the normal power cycle and pumped into the accumulator.

The work curve to be obtained by modifying the valve lift to produce a centered lift condition as shown in FIG. 5A is shown in phantom line in FIG. 6. To obtain such a power curve, it is required that the solenoid valve piston 112 be opened prior to the piston reaching top dead-center position and that it be closed prior to the piston reaching bottom dead-center position. At low speed and full load, one will want to consider using a centered reduced lift as shown in dotted line in FIG. 5A. At high speed and full load, one will want to use the centered lift at maximum valve lift as shown in solid line in FIG. 5A. At low speed and partial load, one will want to consider using the early intake valve closing with reduced lift as shown in dotted line in FIG. 5B. At high speed and partial load, one may also wish to consider using reduced lift as shown in dotted line in FIG. 5B. At an idle condition, it may be well to use a combination of both an early intake valve closing and a centered lift of reduced valve lift as shown in FIG. 5C. All of these combinations are possible by selecting the proper control parameters and regulating the position of the solenoid valve piston 112 in accordance with the selected parameters.

Figure 7A:
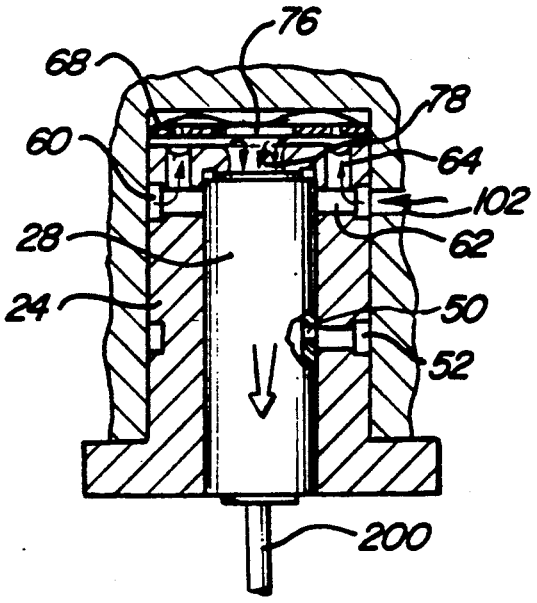
FIGS. 7A–7F schematically show the hydraulic actuation and mode of operation of the upper piston assembly in accordance with the present invention.
Figure 7B:
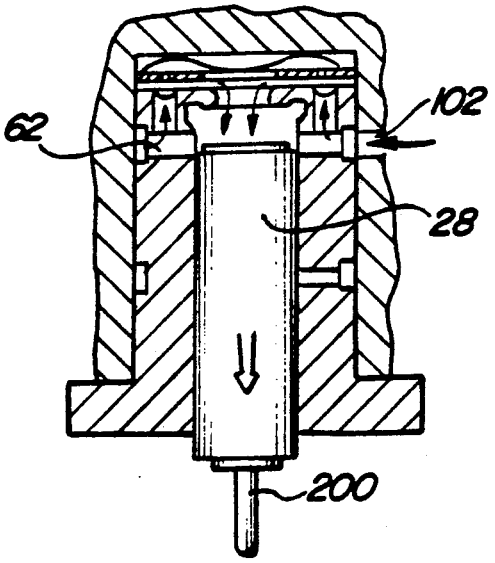
Figure 7C:
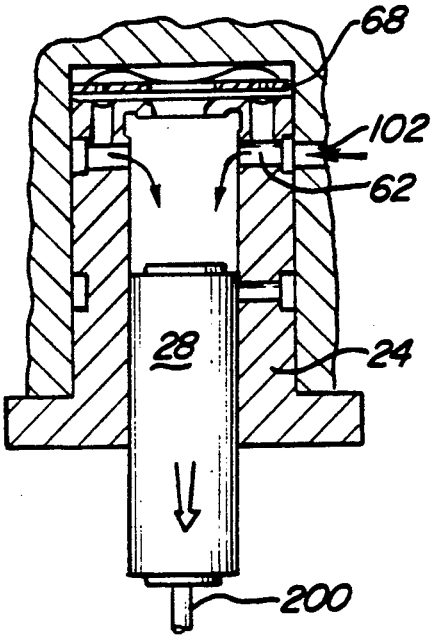

FIGS. 7A–7F show the operational sequence for the valve adjuster piston. This sequence will be followed regardless of the degree of valve lift selected by control of the solenoid valve piston. Very briefly, as shown in FIG. 7A, the valve will begin to open as hydraulic fluid is admitted into free-flow orifices 62 and passageways 64 under check washer 68 and thence through passage 78 to the top of the piston 28. The piston will then move downwardly until it reaches a point as shown in FIG. 7B wherein the free-flow orifices 62 are in direct open communication with the top of the piston 28. At this point, the hydraulic force on the piston head quickly overcomes the compression force of the spring 206 and moves the poppet valve 200 toward its fully open position which means the valve actuating piston 28 will have moved to its fully extended position and washer 68 will be seated on top of housing 24 as shown in FIG. 7C.

Figure 7D:
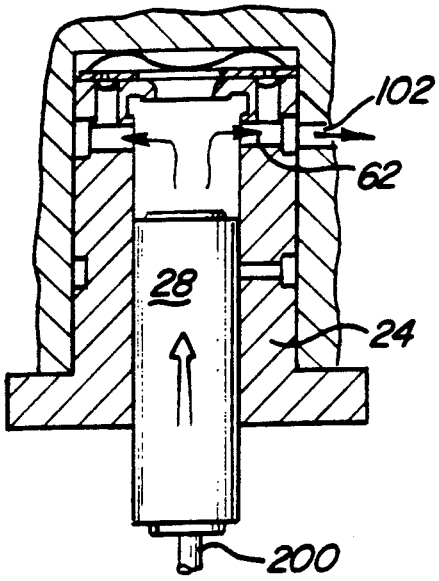
Figure 7E:
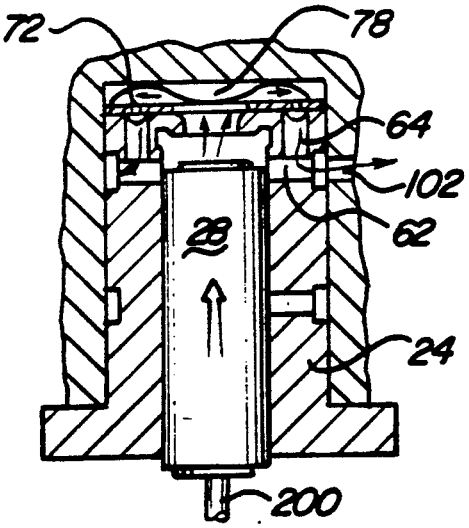

Then as shown in FIG. 7D, as the hydraulic pressure is reduced because of the cam follower piston beginning its return stroke, the force of the compression spring 206 will return the valve adjuster piston. The initial return speed will be fairly rapid as hydraulic fluid is quickly bled through the free-flow orifices 62 to a point where these passages in the housing are being cut off as shown in FIG. 7E. At this point, hydraulic fluid will also pass through upper passageway 78 and through the damping orifices 72 in the impact limiter washer 68 and thence sequentially through passageways 64 and free-flow orifices 62 and passageways 102.

Figure 7F:
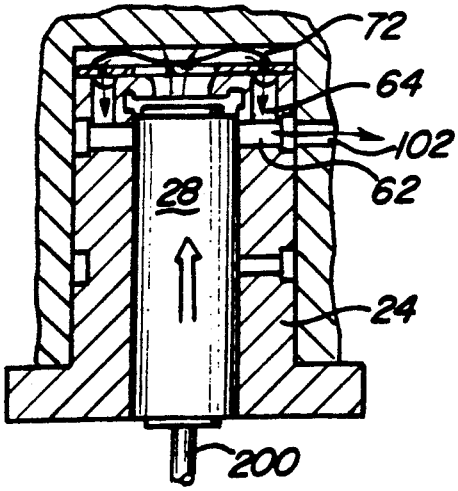

Finally, as shown in FIG. 7F, all fluid will be passed through the impact limiter washer damping orifices 72 as the valve moves to its fully seated or closed position.

It is to be understood that the preferred structure for adjusting the closed position of the valve 200 on the valve seat 202 is as shown in FIG. 1 and described above. By controlling the pressure through the lash adjuster hydraulic circuit as represented by passages 52, 50, 58 and 34, one can maintain the axial position of the lash adjuster piston 36 relative to the valve adjuster piston 28 at any predetermined location. Hydraulic fluid of a prescribed pressure is caused to flow through the passage 34 in intermediate wall 32 against the spring-biased action of the ball valve 48 until the lash adjuster piston is moved outwardly from the valve actuator piston 28 a required amount. The lash adjuster piston will be maintained in this relative position throughout operation of the engine.

Figure 8:
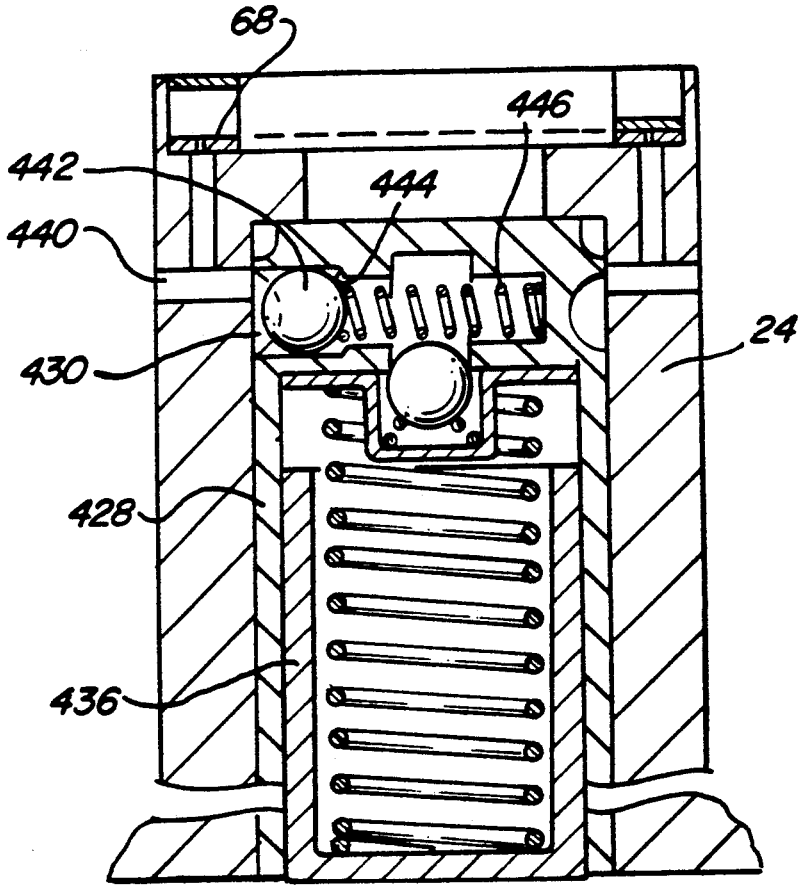
FIG. 8 shows an alternative lash adjuster mechanism for an upper piston assembly in accordance with the present invention.

An alternative lash adjuster mechanism is shown in FIG. 8 wherein the valve actuator piston 428 is limited to a single internal cavity 430 in which is coaxially located a lash adjuster piston 436. The upper end of the valve actuator piston includes a central cavity 438 in fluid communication with a plurality of radially extending hydraulic passages 440 which are in fluid communication with the free-flow orifices 62 formed within the valve actuator housing, and thus are fed by the main hydraulic line rather than a separate lash adjuster hydraulic fluid line as shown in FIG. 1.

The fluid passages 440 include a check valve 442 adapted to be held off a valve seat 444 in a normally open position by a check valve spring 446. The spring rate of check valve spring 446 is chosen to allow the ball to seat at pressures above engine oil pressure. This precludes the possibility of the hydraulic pressure building up or pumping up to the point that the lash adjustment is disturbed during operation of the engine.

Other than the foregoing, the structure and operation of the lash adjuster mechanism and valve actuator assembly are the same as the above-described assembly shown in FIG. 1.

While the best mode for carrying out the invention has been described in detail, those familiar with the art to which this invention relates will recognize alternative designs and embodiments for practicing the invention. For example, while the foregoing detailed description has specifically described the present invention as controlling the engine intake valves, it will be readily apparent from the remainder of the disclosure that the invention is equally applicable to the control of the engine exhaust valves. Thus, the above described preferred embodiment is intended to be illustrative of the invention which may be modified within the scope of the following appended claims.

We claim:

1. A hydraulic engine valve actuating assembly for use in an internal combustion engine cylinder head having a poppet valve which is axially shiftable therein by a rotary camshaft, said hydraulic engine valve actuating assembly comprising:

a housing having a mounted surface to attach to the cylinder head immediately above the poppet valve, said housing having formed therein a first cavity spaced from and oriented non-parallel to the poppet valve, a second cavity coaxially aligned with the poppet valve, and a fluid passageway extending between and hydraulically coupled to said first and second cavities;

a master piston cooperating with the camshaft and sealingly engaging the first cavity to define a first enclosed fluid chamber which varies in displacement as said master piston is reciprocally oscillated by the camshaft to provide a high pressure fluid source;

a slave piston cooperating with the poppet valve and sealingly engaging the housing second cavity to define a second enclosed fluid chamber hydraulically connected with said high pressure fluid source from said cavity and which varies in displacement as the slave piston and poppet valve reciprocally oscillate;

a hydraulic energy and fluid storage accumulator assembly affixed and sealingly engaged relative to said housing and being provided with a fluid port coupled with the housing fluid passageway;

valve means for regulating the flow of fluid through said accumulator fluid port to vary any one or more of valve lift, valve timing or duration of valve opening in response to an input signal;

said housing including a third cavity coaxially aligned with the poppet valve; and said valve means including a reciprocal valve piston sealingly engaged within said third cavity.

2. The invention of claim 1 wherein said valve means comprises a solenoid valve.

3. A hydraulic engine valve actuating assembly for use in an internal combustion engine cylinder head having a poppet valve which is axially shiftable therein by a rotary camshaft, said hydraulic engine valve actuating assembly comprising:

a housing having a mounted surface to attach to the cylinder head immediately above the poppet valve, said housing having formed therein a first cavity spaced from and oriented non-parallel to the poppet valve, a second cavity coaxially aligned with the poppet valve, and a fluid passageway extending between and hydraulically coupled to said first and second cavities;

a master piston cooperating with the camshaft and sealingly engaging the first cavity to define a first enclosed fluid chamber which varies in displacement as said master piston is reciprocally oscillated by the camshaft to provide a high pressure fluid source;

a slave piston cooperating with the poppet valve and sealingly engaging the housing second cavity to define a second enclosed fluid chamber hydraulically connected with said high pressure fluid source from said cavity and which varies in displacement as the slave piston and poppet valve reciprocally oscillate;

a hydraulic energy and fluid storage accumulator assembly affixed and sealingly engaged relative to said housing and being provided with a fluid port coupled with the housing fluid passageway;

valve means for regulating the flow of fluid through said accumulator fluid port to vary any one or more of valve lift, valve timing or duration of valve opening in response to an input signal;

said second cavity being open to said mounted surface and thereby immediately adjacent the poppet valve;

said slave piston at one end being adapted to engage the poppet valve;

said fluid passageway being coupled to the other end of said slave piston;

whereby, as fluid is directed through said fluid passageway from said master cylinder to said slave cylinder, said slave piston is caused to force the poppet valve off a valve seat to allow the ingress or egress of combustion products and reactants;

said slave piston including a lash adjusting means coaxially located therewithin and adapted to directly engage the poppet valve, and means for hydraulically adjusting the axial extent of said lash adjusting means relative to said slave piston;

said housing including a second fluid passageway for admitting fluid from a low pressure fluid source to said lash adjusting means.

4. The invention of claim 3 wherein said lash adjusting means includes a fluid port coupled to said second fluid passageway;

a normally closed spring biased check valve within said port which may be opened at a predetermined hydraulic pressure to extend the axial piston of said lash adjusting means relative to said slave piston;

a normally open spring biased check valve located in said port intermediate said second fluid passageway and said normally closed check valve; and said normally open check valve being adapted to close upon receiving a hydraulic pressure exceeding said predetermined pressure.

5. In an internal combustion engine having a cylinder head assembly, a camshaft rotatably supported on the cylinder head assembly and having a plurality of cam lobes operatively coupled to a plurality of spring biased normally closed poppet valves for controlling the ingress or egress of combustion products and reactants to a plurality of combustion chambers serially arranged along the longitudinal extent of said camshaft;

said poppet valves being retained within the cylinder head assembly;

a valve lifter assembly being completely contained as a single unit and mounted directly to the cylinder head assembly as a single unit in association with a respective combustion chamber;

said valve lifter assembly being intermediate said camshaft and said cylinder head assembly for controlling the opening and closing of one of said poppet valves off an associated valve seat within a respective combustion chamber as controlled by the timed rotation of said camshaft;

said valve lifter assembly including a housing having a mounted surface to attach to the cylinder head assembly immediately above said poppet valve, said housing having formed therein a first cavity spaced from and oriented non-parallel to said poppet valve, a second cavity coaxially aligned with said poppet valve, and a fluid passageway extending between and hydraulically coupled to said first and second cavities;

a master piston cooperating with the camshaft and sealingly engaging the first cavity to define a first enclosed fluid chamber which varies in displacement as said master piston is reciprocally oscillated by the camshaft;

a slave piston cooperating with said poppet valve and sealingly engaging the housing second cavity to define a second enclosed fluid chamber which varies in displacement as the slave piston and poppet valve reciprocally oscillate;

a hydraulic energy and fluid storage accumulator assembly affixed and sealingly engaged relative to said housing and being provided with a fluid port coupled with the housing fluid passageway; and valve means for regulating the flow of fluid through said accumulator fluid port to vary any of valve lift, valve timing, and duration of valve opening in response to an input signal.

6. A hydraulic engine valve actuating assembly for use in an internal combustion engine cylinder head having a poppet valve which is axially shiftable therein by a rotary camshaft, said hydraulic valve lifter assembly comprising:

a generally annular housing having a lowermost mounted surface to allow attaching said housing to the cylinder head immediately adjacent the poppet valve and in coaxial alignment therewith, said housing having formed therein a first annular cavity disposed about a first axis and spaced from and oriented at an angle relative to the axis of the poppet valve, a second annular cavity disposed about a second axis and coaxially aligned with the poppet valve, and a fluid passageway extending between and hydraulically coupled to said first and second cavities;

a cylindrical master piston cooperating with the camshaft and sealingly engaging the first annular cavity to define a first enclosed fluid chamber which varies in displacement as said master piston is reciprocally oscillated by the camshaft;

a cylindrical slave piston cooperating with the poppet valve and sealingly engaging the housing second annular cavity to define a second enclosed fluid chamber which varies in displacement as the slave piston and poppet valve reciprocally oscillate;

a hydraulic energy and fluid storage accumulator affixed to said housing provided with an input/output port cooperating with the housing fluid passageway;

valve means for regulating the flow of fluid through the accumulator input/output port to vary any one of valve lift, valve timing or duration of valve opening in response to an input signal;

said angle between said first axis and said second axis being in the range of about 15° to about 70° whereby the spacing between the camshaft and the cylinder head may be maintained at a minimum;

a spring biased annular damping washer member interposed within said second fluid chamber and being normally closed whereby the full flow of fluid from said fluid passageway is precluded, said damping washer member having at least one damping orifice providing constantly open but limited fluid communication between said first fluid chamber and said second fluid chamber whereby the relative speed at which said slave piston may be reciprocated within said second cavity may be controlled by sizing said damping orifice, and said first and second fluid chambers relative to one another.

7. The invention of claim 6 wherein said housing including first and second inlet ports coupled with said fluid passageway;

said slave piston including a piston head at one end thereof, a fluid chamber within said second cavity bounded by said piston head;

said fluid chamber being in constant open communication with said first inlet port; and said second port being axially spaced from said first port and normally closed to said fluid by said slave piston.

* * * * *